US005958865A

United States Patent [19]

Kline et al.

[11] Patent Number: 5,958,865

[45] Date of Patent: Sep. 28, 1999

[54] SINGLE PASS PROCESS FOR MAKING AN INCREASED SURFACTANT LOADED DETERGENT USING AN AGGLOMERATOR

[75] Inventors: Eric J. Kline, Churchville, Pa.; Jim Mahar, Loomis, Calif.; Anthony P. Zampirri, Oreland, Pa.

[73] Assignee: FMC Corporation, Philadelphia, Pa.

[21] Appl. No.: 08/880,186

[22] Filed: Jun. 20, 1997

Related U.S. Application Data

[63] Continuation-in-part of application No. 08/810,040, Mar. 4, 1997, abandoned

[60] Provisional application No. 60/022,511, Jun. 28, 1996.

[51] Int. Cl.[6] ..... C11D 11/00

[52] U.S. Cl. ..... 510/444; 510/509; 510/511; 510/276; 23/313 R; 23/313 AS; 264/117

[58] Field of Search ..... 510/444, 509, 510/511, 276; 23/313 R, 313 AS; 264/117

[56] References Cited

U.S. PATENT DOCUMENTS

| | | | |
|---|---|---|---|
| 3,609,088 | 9/1971 | Sumner | 510/232 |
| 3,625,902 | 12/1971 | Sumner | 510/232 |
| 3,886,098 | 5/1975 | Disalvo et al. | 510/326 |
| 3,888,781 | 6/1975 | Kingry et al. | 510/229 |
| 4,141,841 | 2/1979 | McDanald | 510/330 |
| 4,274,975 | 6/1981 | Corkill et al. | 510/395 |
| 4,427,417 | 1/1984 | Porasik | 23/313 R |
| 4,457,854 | 7/1984 | Gangwisch et al. | 510/356 |
| 4,605,509 | 8/1986 | Corkill et al. | 510/352 |
| 4,992,079 | 2/1991 | Lutz | 23/313 R |
| 5,302,310 | 4/1994 | Houghton | 510/438 |
| 5,443,751 | 8/1995 | Mazzola | 510/349 |
| 5,468,411 | 11/1995 | Dixit et al. | 510/226 |
| 5,714,451 | 2/1998 | Brouwer et al. | 510/324 |

*Primary Examiner*—Lorna Douyon
*Attorney, Agent, or Firm*—FMC Corporation

[57] ABSTRACT

A process of making a powdered detergent aggregate comprising in a single pass process the step of introducing an absorptive soda ash into an agglomerator, forming a soda ash curtain within the agglomerator, spraying a surfactant onto the soda ash curtain, forming a curtain of resultant soda ash/surfactant product, spraying a silicate thereon, and adding additional surfactant to produce a non-caking soda ash/silicate/surfactant aggregate having 40–69 weight percent soda ash, 7–14 weight percent silicate, and 14–26 weight percent surfactant having a loose bulk density of from 600–1000 g/l.

13 Claims, 3 Drawing Sheets

SINGLE PASS PROCESS FOR MAKING AN INCREASED SURFACTANT LOADED DETERGENT USING AN AGGLOMERATOR

This is a continuation-in-part of U.S. patent application Ser. No. 08/810,040 filed Mar. 4, 1997 now abandoned which is based on U.S. Provisional Patent Application Ser. No. 60/022,511 filed Jun. 28, 1996. The invention relates to the production of an agglomerated detergent, more particularly to a soda ash based detergent having a high surfactant loading and the process for making it.

FIELD OF THE INVENTION

BACKGROUND OF THE INVENTION

The term powdered detergent has more than one meaning. In the most basic sense a detergent is the surfactant used for washing clothes, typically as a soda ash/surfactant/silicate agglomerate collection. In the home laundry market a detergent is a formulation used for washing clothes; as such, a detergent includes the soda ash/surfactant/silicate combination, and may also include granules of opacifiers, perfumes, and other ingredients. Here the term detergent is limited to the sense of a soda ash/surfactant/silicate agglomerate collection, unless otherwise noted.

A detergent is sometimes characterized by its loose bulk density, which is the weight per unit volume of detergent, determined without tapping. In the home laundry market, the formulation sold to the consumer preferably has a loose bulk density of from 600 g/L to 800 g/L. The soda ash/surfactant/silicate agglomerate that is used in such home laundry formulations is typically prepared using either a densifying spray tower, or a high shear mixing device followed by a fluid bed dryer. Both methods are capital intensive to install, and expensive to operate. Other more economical processes have not provided a suitable soda ash/surfactant/silicate aggregate. Such other processes include the typical high-bulk-density agglomeration methods, which generally are limited to producing a soda ash/surfactant/silicate powder aggregate that is used in home laundry formulations having a loose bulk density of 801–961 g/L (50–60 lb/cu ft) and the traditional spray drying methods, which are generally limited to producing a soda ash/surfactant/silicate aggregate that is used in home laundry detergent formulations having a loose bulk density of 320–480 g/L (20–30 lb/cu ft). Because of competitive pressures, the use of less expensive equipment, both in initial cost and also an on-going operating expense basis, is desirable.

U.S. Pat. No. 4,992,079 assigned to FMC Corporation teaches one such useful process.

SUMMARY OF THE INVENTION

We have discovered a process for making, in an O'Brien agglomerator, a powdered detergent aggregate with a loose bulk density of 600–1000 grams per liter (g/L), and that is made up of an absorptive soda ash, silicate, and greater than 15 weight percent surfactant, and the composition made thereby. The method for producing detergent, optionally without the addition of heat to the process other than the heat contained in the ingredients used therein, includes the steps of introducing an absorptive soda ash into an agglomerator, forming a soda ash curtain within the agglomerator, spraying a surfactant onto the soda ash curtain, then forming a curtain of resultant soda ash/surfactant product, and spraying a silicate thereon, to provide a caking free, soda ash, silicate and surfactant agglomerate having more than 15 weight percent surfactant based on the total dry weight of the agglomerate.

In a further aspect, we have discovered a method for producing a detergent, comprising in a single pass process, without adding heat other than the heat contained in the ingredients used therein, of introducing a soda ash to an agglomerator, forming a soda ash curtain within the agglomerator, spraying a surfactant onto the soda ash curtain, then forming a curtain of the resultant soda ash/surfactant product, and spraying a silicate thereon, wherein the soda ash, silicate and surfactant are used on a percentage basis 40–69, 7–14, 14–22, respectively based on the total weight of the soda ash, silicate, surfactant, and water of hydration in the detergent and the product has a loose bulk density within the range of from 600–1000 g/L, and then in the same single pass process spraying the first detergent agglomerate with from 4 to 9 weight percent additional surfactant to provide a soda ash, silicate, surfactant agglomerate having from 19–26 weight percent surfactant.

The detergent can optionally be prepared with or without phosphate. A detergent is phosphate free when it contains less than 1 wt % phosphate.

DESCRIPTION OF THE PREFERRED EMBODIMENTS

Figure 1:
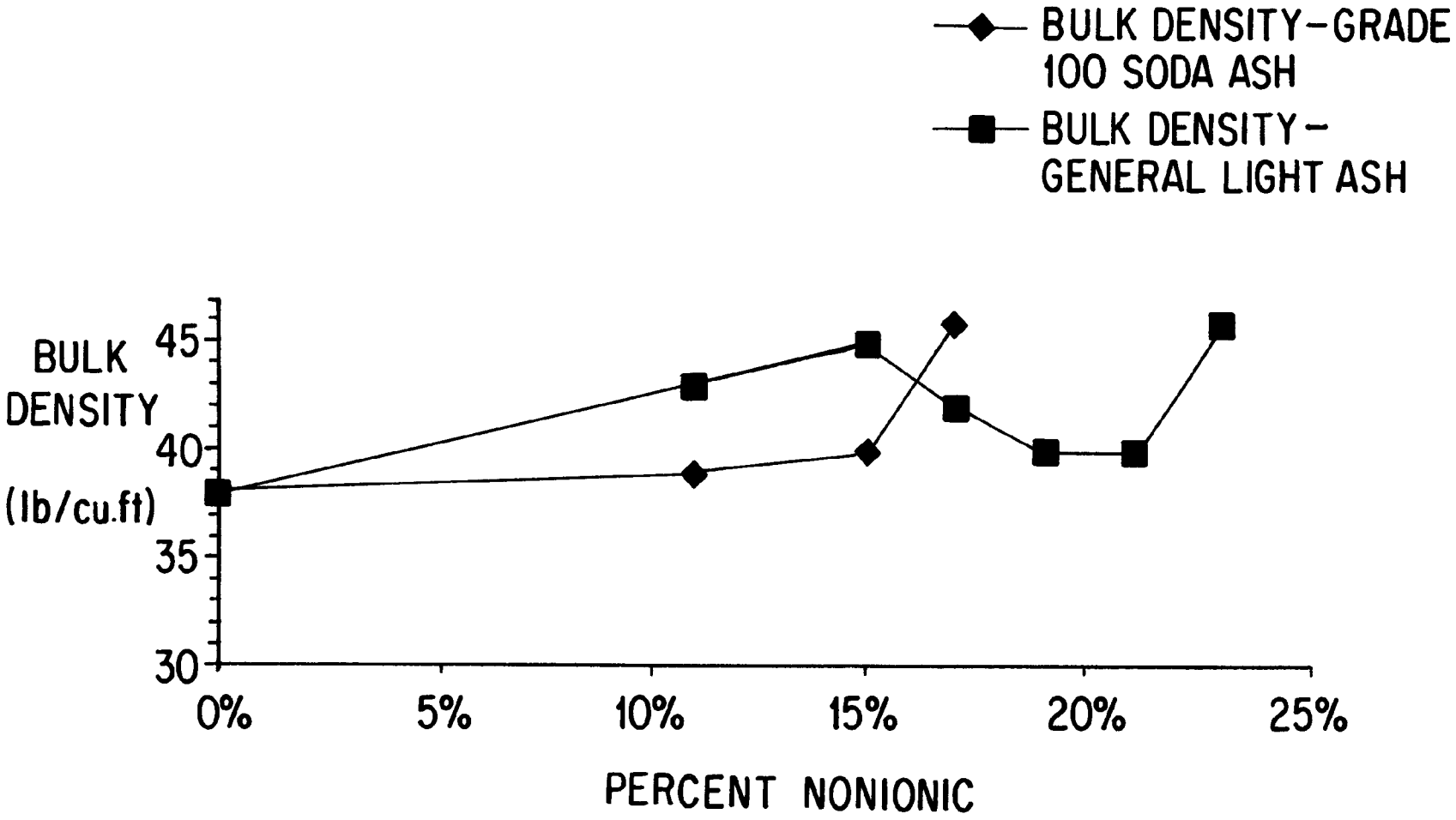
FIG. 1 is a graph depicting the loose bulk density vs. percent nonionic surfactant content of a 25 wt % silicate containing soda ash.

The process of the invention employs an agglomerator that can form a curtain of particles and includes a sprayer for applying ingredients to those particles. Agglomerators that can form a curtain include the O'Brien agglomerator, the Schugi agglomerator, and the Patterson Kelley agglomerator. In the O'Brien agglomerator, the curtain is formed by cascading the powder, while the Schugi Agglomerator forms a cyclonic curtain and the Patterson Kelley agglomerator forms a modified cyclonic curtain. Of these, the cascading curtain of the O'Brien agglomerator is preferred because it provides the least forceful contact among the particles during processing. All such agglomerators include provisions for a device that can spray a substance onto the curtain of particles.

The processes of this invention do not require a heat source. Although heat can be separately applied using procedures known in the field, generally, the heat, if any, is supplied by the temperature of the ingredients used in the process. And in the examples provided herein, all of the ingredients are used at room temperature, unless otherwise specified.

In the O'Brien agglomerator, a curtain of soda ash, usually as a powder, is formed by lifting particulate soda ash to an elevated position within the agglomerator through a process of internal mechanical rotation, and then forming a cascading curtain of particulate soda ash by permitting the elevated soda ash to free fall. Surfactant is sprayed onto that curtain and absorbed by the soda ash it comes into contact with. Through continuing rotation, a curtain of that soda ash containing the absorbed soda ash can be formed and subjected to one or more of the following: conditioning, spraying more surfactant thereon, or spraying on another ingredient, such as aqueous silicate. Thus, a detergent can be produced within a single agglomerator on a single pass through basis. Moreover, it has been determined that this can be accomplished without preconditioning the soda ash used.

Generally, the second chemical to be sprayed is the aqueous silicate. If that is the last chemical to be sprayed, then the detergent formed thereby is optionally conditioned by continuing to form a curtain of the detergent for a period of from 2 to 60 minutes, on either a continual or a continuous basis. Such a detergent can be characterized as having from 14 to 23 weight percent surfactant, preferably from 15 to 20 weight percent surfactant, and most preferably from 14 to 19 weight percent surfactant. The detergent can be further characterized as having a loose bulk density of at least 600 g/L, and preferably a loose bulk density greater than 700 g/L. The preferred range is from 600 to 1000 g/L, with the range of from 600 to 700 g/L being a low bulk density detergent and the range from above 700 to up to 1000 g/L being a medium bulk density material. A 600 to 800 g/L and a 700–900g/L detergent can also be prepared.

If additional surfactant loading is desired, then either following or prior to the conditioning step described above, a curtain of the above formed detergent is prepared and additional surfactant is sprayed onto the curtain formed. In this manner active levels are further increased through use of a secondary surfactant addition to the agglomerated material to yield a stable, non-bleeding product containing up to 26% surfactant on a total product basis. The finished detergent formed thereby can have a loose bulk density of at least 600 g/L, preferably from 600 to 1000 g/L, and most preferably from 600 to 800 g/L and a weight percent surfactant of from 14 to 26, and most preferably from 18 to 26. As above, this is followed by conditioning by continually forming a cascading curtain of the detergent formed for a period of from 0–60 minutes.

In any of the above steps, more than one cycle of forming a curtain and/or spraying can be used. In this manner, additional chemical can be added to the substrate being treated and/or time for proper conditioning can be provided. In addition, a conditioning step can be optionally used following each spray application step. Conditioning steps are desired because they tend to permit each particle of agglomerate to stabilize by equilibration, or otherwise, prior to further processing or use.

To obtain the high surfactant loading of this invention, it is critical that the soda ash used be an absorptive soda ash. The term "absorptive soda ash" is well known in the art of detergent manufacturing. Typically, absorptive soda ash is a soda ash that can absorb from about 17 to 28 wt % surfactant. Such an ash can be either natural or synthetic. Soda ash used in this invention will generally have a length to width ratio of 5:1 to 2.5:1. A natural absorptive soda ash is one that has been obtained from trona ore, and can generally be characterized by a length to width aspect ratio which can be provided by a pseudomorph of sesquicarbonate. Such pseudomorphs typically have an aspect ratio of about 2:1 to 3:1 and include Grade 100™ soda ash or AbsorptaPlus™ soda ash, either of which is suitable for this purpose. Grade 100 and AbsorptaPlus are both trademarks of the FMC Corporation for an absorptive soda ash that is a pseudomorph of sesquicarbonate. Because of this aspect ratio, these pseudomorphs of sesquicarbonate do not tend to produce an agglomerate having a smooth exterior surface. Instead, the agglomerated sesquicarbonate crystals overlap, creating interstices in the overlap, which receive, collect and retain surfactant sprayed thereon. Thus, these agglomerates can collect surfactant, not only because of their natural absorptivity, but also because of these physical interstices between the ends of the agglomerated particles. This makes the agglomerates quite suited to additional surfactant loading through a second surfactant addition step, which is a surfactant post addition that takes place following the silicate addition step.

All other absorptive soda ash tends to be synthetic soda ash, produced from other than trona. One such product is produced by a modification of the well known Solvay Process, such as General Chemical Lite™ soda ash. Synthetic light ash tends to be, relative to pseudomorphs of sesquicarbonate, relatively small and more spherical, not as elongated or the above described pseudomorphs of sesquicarbonate. As a consequence, the interstices formed with agglomerated light ash tend to be less pronounced. Consequently, surfactant loading for the light ash is due mostly to it inherent absorptivity. Nevertheless, both the pseudomorph and the synthetic light ash, as well as mixtures thereof can be used according to the processes of this invention. However, absorptive soda ash that is a pseudomorph of sesquicarbonate tends to give less erratic, thus more consistent, results than is normally provided by synthetic light soda ash, which is not a pseudomorph of sesquicarbonate.

Other soda ash, such as a dense soda ash produced by the monhydrate process, would not, by itself, be suitable, because it would not be sufficiently absorbent.

In order to obtain high surfactant loadings, it is preferable to produce a product having a surfactant that is either nonionic surfactant only or is a mixture of nonionic and anionic surfactant. Anionic surfactant alone can be used; however, it tends not to be as effective for high surfactant loadings. In one example, the final product was 17% for either nonionic alone or in a mixed active system (2:1 nonionic-to-anionic weight ratio). When sulfonic acid (the anionic surfactant source) was used alone, the maximum level was 13%. Both of these tests were conducted without the post addition of surfactant.

In addition, the surfactant application can occur in two discrete steps. Generally, when two steps are used, the nonionic surfactant would be applied first and the anionic surfactant would be applied second.

A higher surfactant actives level can be achieved by a second addition of surfactant to the already agglomerated product. Initial work has shown that the total nonionic level can be increased from the "single addition" 17% maximum to over 23% as a final formulated product in this manner. This second addition detergent can be further characterized as having a loose bulk density of at least 600 g/L, and preferably a loose bulk density greater than 700 g/L. Although the preferred range is from 600 to 1000 g/L, with the range of from 600 to 700 g/L being a low bulk density detergent and the range from above 700 to up to 1000 g/L being a medium bulk density material. Detergents having bulk densities of from 600 to 800 g/L and 700–900g/L can also be prepared.

Without the post addition step of adding additional surfactant, other preferred soda ash/silicate/surfactant aggregates include the following:

An aggregate containing 50–60 weight percent soda ash, 7–12 percent silicate, and 14–23 percent surfactant.

An aggregate containing 40–50 weight percent soda ash, 8–14 percent silicate, and 14–23 percent surfactant.

With a post addition step, other preferred aggregates include the following:

An aggregate containing 50–60 percent soda ash, 6–12 percent silicate, and 17 to 26 percent surfactant.

An aggregate containing 40–50 percent soda ash, 8–14 percent silicate, and 17–26 percent surfactant.

An aggregate containing 40–69 percent soda ash, 7–14 percent silicate and 17–26 percent surfactant.

Net active levels can be further increased above those found in this study through the following methods, practiced singly or in combination:

a. Use nonionics that are pastes or solids at ambient temperatures. These materials would "fill the voids" created by the agglomeration of Grade 100™ soda ash or AbsorptaPlus™ soda ash, thus increasing net active content.

b. Use a small amount of high-absorbing material, such as zeolite, puffed borax, or other such material, to increase nonionic absorption prior to silicate addition. The silicate will agglomerate the total mix and produce a homogeneous-appearing final product.

c. Use a second silicate spray, after all actives have been added, to "seal in" any nonabsorbed material that otherwise might contribute to active bleeding.

d. Use a combination of an absorptive soda ash that is a pseudomorph of sesquicarbonate and a powdered soda ash that is not, either combined in the base feed or utilizing the powdered soda ash as a mid-agglomerator individual feed prior to the silicate spray.

e. Use fine tuning of the particle size of the powder feed to help control the overall agglomeration process. Also, adding a small amount of powdered soda ash just before the silicate is sprayed may nullify some of the interaction between the active on the surface of the particles and the liquid silicate.

All of the work described herein was performed as a "worst case" situation without any agglomerator air flows. Experience has shown that air flow within the agglomerator helps processing by providing some control over the silicate drying, and thus the degree of agglomeration.

The following examples illustrate the invention, but are not intended to limit the scope thereof. In the examples and throughout the specification, all percentages used herein are weight percentages, all temperatures are in ° C., and all numbers include the qualifier "about," unless otherwise indicated.

DISCUSSION OF EXPERIMENTAL CONDITIONS

1. Run Data

The experimental runs are summarized in Tables I through III (B).

The operating conditions common to all runs are given in Tables III(A) and III (B). Some initial runs were made to determine batch size, optimal spraying conditions for silicate and actives, and other operating conditions. Once determined, these baseline operating conditions were held constant unless a specific test condition required that a change be made. Any changes are noted in the Tables.

2. Agglomerator

Except as may be otherwise indicated, all of the runs were conducted in an O'Brien Pilot Agglomerator, having internal dimensions of approximately 3' diameter by 1' in depth. This shows how the finer powder is processed so that smaller particles can be preferentially sprayed with silicate for agglomeration.

In each run, the agglomerator rotation speed was set to the minimum rotation setting that would form a curtain of falling fines to be exposed to the silicate spray. The spray bar was set at the farthest distance possible to minimize the possibility of spray penetration through the curtain to the agglomerator shell. Except as otherwise noted, standard spray heads were used.

3. Liquid Silicate

RU Silicate ($SiO_2/Na_2O$=2.40), a product of the PQ Corporation was used as the silicate source in the examples. With a solids content of 47%, this product delivers around 12% solid silicate and 13% water at a dose level of 25%. Other silicate sources commonly used in making agglomerates can also be used. Thus, 25% silicate refers to silicate solution, containing about 12.5 dry silicate. Thus, where silicate is referred to in the claims, the dry silicate is described, but as a consequence of the fact that the silicate used in the process contains the described amount of water, approximately an equal amount water is brought into the system.

The silicate was used in one of four different conditions: "as is" or diluted with 10% added water; and either heated to 70° C. or used at room temperature. The tables show the silicate test condition for each run.

4. Silicate Spray

A Spraying Systems Company external mix spray nozzle #SUE 45B was used for all silicate additions. An atomizing nozzle such as this is not normally the nozzle of choice in this application. However, the mechanism that was postulated to produce the lowest product densities and highest active levels, could only occur with the minimum amount of silicate that is necessary to form the powder voids and still dry to produce a stable particle. Any excess of silicate, as would be likely with the usual flat spray nozzle, fills the voids with silicate thus increasing bulk density and decreasing void area for active absorption.

Spray rate was controlled by air pressure to the spray feed chamber holding the pre-heated silicate or surfactant. For all silicate spraying, the atomizing air pressure was chosen to be as close as possible to the silicate spray pressure that would still produce an atomized spray pattern.

To avoid dried silicate from plugging the spray nozzle orifice, hot water was used to preheat the nozzle and piping prior to silicate spraying.

5. Surfactants

In the Examples, both nonionic and anionic surfactants were used. The nonionic surfactants that were used were Neodol 25-9 nonionic surfactant, Neodol 25-7 nonionic surfactant, and Genapol UD-080 nonionic surfactant. All of these materials were considered interchangeable for the purposes of this report. The anionic used was a linear alkyl sulfonic acid (SFA) produced by both Witco and Stepan.

Other suitable nonionic surfactants, useful singly or in admixture of two or more, include any of the polyoxyethylene condensates, also known as "ethoxylate"; alcohol ethoxylates; alkylphenol ethoxylates; carboxylic acid esters; glycerol esters; polyoxyethylene esters; anhydrosorbitol esters; ethoxylated anhydrosorbitol esters; ethoxylated anhydrosorbitol esters; ethoxylated natural fats, oils and waxes; glycol esters of fatty acid; carboxylic amides such as diethanolamine and monoalkanolamine condensates, and polyoxyethylene fatty acid amide; polyalkylene oxide block copolymers; and poly(oxyethylene-co-oxypropylene) polymers. Of the foregoing, the polyoxethylenes and alcohol ehtoxylates are preferred. Representative of the latter are materials sold under the trademark and designation "Neodol," for example, condensates of the formula $R(OCH_2CH_2)_nOH$ wherein n varies from about 3 to 10 and R is a straight or branched hydrocarbon chain containing from about 12 to 15 carbon atoms.

Other suitable anionic surfactants include those that may be prepared by sulfating the foregoing nonionic alcohol ethoxylate surfactants known manner. For example, if it is desired to use a mixture of nonionic and anionic surfactants, the nonionic may be treated with the requisite amount of sulfuric acid to convert a portion of the nonionic into the sulfated anionic form. Alternatively, the anionic surfactants may be separately prepared and blended with the soda ash or with a nonionic surfactant prior to addition to the soda ash. A wide variety of anionics, useful singly or in mixtures of two or more, are commercially available for this purpose and include carboxylates such as acid containing fluorinated alkyl chains, polyalkoxycarboxylates, N-acyl sarcosinates, and acylated protein hydrolysates. Other anionic surfactants include alkylsulfonates, alkylbenzenesulfonates such as dodecylbenzenesulfonate, alkylarenesulfonates, lignosulfonates, naphthalene sulfonates, alpha-olefin sulfonates, petroleum sulfonates, dialkylsulfosuccinates, amidosulfonates and 2-sulfoethyl esters of fatty acids. Other anionic surfactants include sulfates such as alcohol sulfates, for example, sodium lauryl sulfate, ethoxylated-sulfated alcohol, alkylphenol which have been ethoxylated and sulfated, sulfated acids, amides and esters, and sulfated natural oils and fats. Of the foregoing, the alkylbenzenesulfonates are preferred. The foregoing and other suitable nonionic and anionic surfactants are well-known.

A flat spray nozzle (Unijet #8004) also from Spray Systems Company was used for the nonionic and sulfonic acid addition.

6. Comparative Example 1

The procedure described above for this invention was followed, and is provided in Table 1.

In this Example, despite the fact that there is no second surfactant addition step to increase surfactant levels, the initial agglomerator run of this example provided a product with a bulk density of 689 g/L (43 lb/cu ft), a product acceptable to many users.

This density or silicate level result could not be duplicated in the lab at the "glassware scale". This indicates that lab bench work cannot realistically predict the results from larger scale equipment such as the O'Brien Lab Agglomerator.

TABLE 1

| | |
|---|---|
| Soda Ash | 55% |
| Silicate** | 12% |
| Added Water | 13% |
| Nonionic | 11% |
| SFA | 3% |
| Total | 100% |

**See description of silicate content in paragraph 3 above

Order of addition

In all runs, unless specified otherwise, a single pass through the system was used with the following order of addition:

1. soda ash was introduced to agglomerator and a curtain formed;
2. nonionic surfactant (if used) was then sprayed onto soda ash; mixed one minute;
3. SFA (a linear dodecyl benzene sulfonic acid(if used) was sprayed onto a curtain of the product of step 2, and mixed one minute;
4. silicate was sprayed onto a curtain of the product of step 3, and then conditioned approximately 30 minutes; and
5. a nonionic surfactant(if any) sprayed onto a powder curtain formed from the product of step 4, as a post addition and then mixed for 5 minutes.

7. Other Test Conditions

No added heat or agglomerator air flow was used, and the ingredients were used at room temperature unless otherwise indicated in the Tables. This study focused on the silicate "hardening" within the agglomerator as it interacts with the powder base, rather than with external air flows. It is recognized that air movement around the drying silicate can influence final powder properties. By excluding the effect of air flows, this data isolates the influence of silicate on the powder base. This work is then presented as a "worst case" study; further engineered air flows or humidity control can only help improve the process, production rate, and/or the final product. All final products were conditioned by tumbling in the O'Brien agglomerator for an additional 30 minutes after all liquid silicate addition ended. This conditioning step is needed to give the silicate time to fully "set" prior to discharge to a storage container. This conditioning time simulates the rotary dryer that is commonly used in conjunction with this type of agglomerator. The data uniformly shows that without this conditioning step, product caking was severe in all cases. Caking results (Table III) indicate that, even with this conditioning time, engineered drying curves will be needed to size a proper rotary dryer for each industrial application.

In all agglomeration operations, product grading is required to remove particles that are either too large, or sometimes too small. This study selected a screen cut of -10 mesh to remove all oversize particles. All screened oversize particles can be reprocessed and recycled within the process.

Tests were run to evaluate the need to pre-absorb active materials onto the powder base prior to agglomeration, compared to simply spraying the active within the agglomerator immediately prior to silicate addition.

RESULTS

1. Bulk density as a function of silicate content only.

Lab work showed that it is possible to achieve significantly lower bulk densities in detergent powders than would be expected from the normal "sum-of-the-densities-of-the-raw-materials" calculation. The needle shape of Grade 100™ soda ash or of the AbsorptaPlus™ soda ash, when agglomerated with liquid silicate, helped in producing a particle with spikes of the soda ash.

These spiked agglomerates create large void areas, and thus increase pore volume. The larger void space accounts for the decreased product density. The increased porosity also allows more surfactant to be held in the powder matrix. Surfactant in the larger void spaces can be "sealed" with an additional coating of silicate, thus further increasing net active content without bleeding.

The mechanism of spike formation is thought to be the result of a fine spray of a fast-setting water soluble silicate holding the needle particles at random angles to produce void areas. The silicate must set quickly enough to avoid densification from breakdown during conditioning and other mechanical handling. It is important to note that these spikes cannot be formed in sufficient number using a fine-powdered soda ash (such as General Chemical synthetic light soda ash) or any other particle that is mostly spherical in nature.

RU silicate additions have an effect on the density of Grade 100 soda ash alone. In a study, the amount of silicate used was varied from 0 to 30 weight percent. In runs over 30% silicate, the agglomeration was judged to be past the useful peak. No further test runs were made at higher levels. Undiluted and higher viscosity silicate solution initially gave an increase in bulk density, both materials provided a minimum bulk density at 25% silicate. This suggests that the system is independent of low levels of water added when processing for minimum density.

2. Maximum Nonionic Content at a constant 25% silicate.

In order to demonstrate the effect of nonionic addition levels, tests were run at a constant 25% silicate. This level was chosen since it represented the minimum bulk density point, and it provides a large amount of silicate for spike formation. Two series of tests were run for the soda ash-nonionic-silicate system. One series used FMC Grade 100 soda ash as the base, the other used General Chemical synthetic light soda ash as the base. FIG. 1 shows this data for both base these absorptive soda ash base powders. This data, which excludes the effect of a secondary addition of nonionic, exhibits two interesting effects:

A. As depicted in FIG. 1, for the Grade 100 series (the "diamonds" on the above graph), the density curve is quite linear until near the porosity saturation point (about 17% nonionic with this formulation). Common sense would indicate that, as the denser nonionic is added to the mix, the net density should slowly increase, rather than remain constant.

It should be noted that the curve for General Chemical synthetic light soda ash (the "squares" on the above graph) is not always denser.

B. The General Chemical curve also shows a higher net active level before significant bleeding was noticed.

The odd behavior of the nonionic addition without density increase using G100 might be explained as follows. Nonionics are known to gel when they contact water. Some of the absorbed nonionic may experience this gelling when it contacts moisture from the silicate. This expanded gel is likely to have a lower net density. The silicate, giving up some of its water to the nonionic, then increases in viscosity due to moisture loss (promoting silicate hardening). This is the classic mechanism for silicate drying, although usually drying may be considered to be a moisture loss to air flow or hydratable chemical species. This drying or setting silicate then seals the gel into the voids at its gelled lower density.

As more nonionic is used in subsequent experimental runs, this gelling and coating by silicate also increases in frequency to offset any density increase that otherwise would be expected. This density maintenance phenomenon stops when the effective porosity is exceeded, thus accounting for the density increase above 17% nonionic.

The absence of this "density maintaining effect" for the General Chemical synthetic light soda ash can be explained by the significant difference in particle shape and flow characteristics. Powdered soda ash, essentially spherical particles, may create some similar voids, but the number of stable voids may be small. Also, the inherent flow characteristics of all very fine powders, including powdered soda ash, makes contact with sufficient amounts of nonionic and silicate moisture to form gels much more unlikely and unpredictable.

The other interesting effect in this graph is that the powdered General Chemical synthetic light soda ash allows higher net nonionic levels to be obtained. This could be explained by the fine powdered soda ash coating unabsorbed nonionic, reducing its ability to bleed. The effect may be similar to dedusting a very fine product with only a small amount of mineral oil.

It is likely that a combination of Grade 100 ash (for spike formation) coupled with a minor amount of powdered soda ash, introduced at the correct time to "dedust" any excess nonionic, might allow the best of both situations.

3. Dry Neutralization of Sulfonic Acid on Grade 100 Soda Ash.

Figure 2:
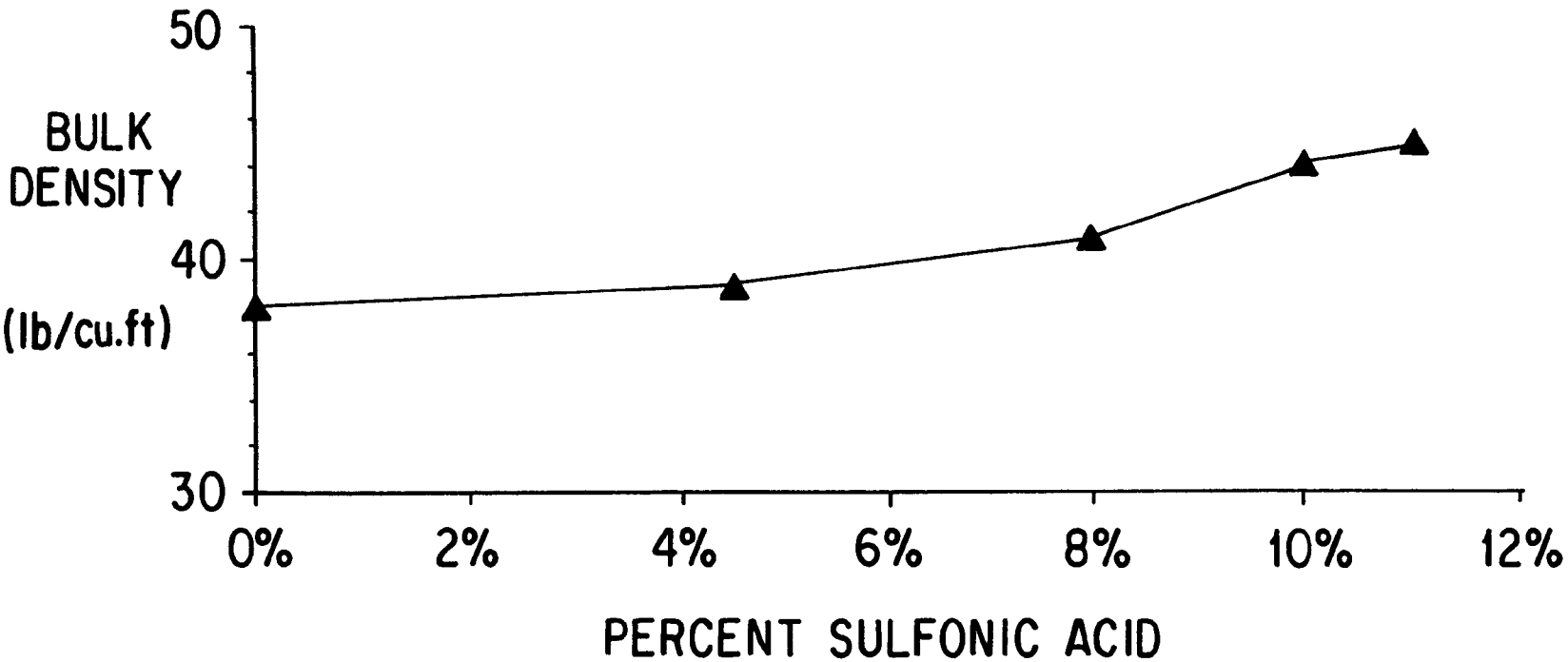
FIG. 2 is a graph depicting the loose bulk density for a detergent vs. sulfonic acid content at on a soda ash having 25 wt % silicate.

Sulfonic Acid (SFA) was sprayed onto the soda ash bed for in situ neutralization to form LAS (linear alkly sulfonate). Since this absorption of the neutralized salt is mostly a physical phenomenon, the relationship is believed to be linear. The data supports this concept. The maximum level of SFA achieved without processing problems was 15% as SFA. The change in density with increasing sulfonic acid at 25% silicate is shown in FIG. 2.

This work, as represented by the above graph, supports the concept of linear density increases with increasing SFA content. This data also supports the explanation given above for the "nonionic density maintaining effect" since neither SFA nor its neutralized salt, LAS, gels in water as the nonionics will.

One run was made using SFA on General Chemical synthetic light soda ash. This product showed successful processing at 13% SFA, and had a final product density of 35 lb/cu ft. This higher level, and lower density, must be attributed to the particle size of the powdered ash. This may also be exploited by mixing a small amount of powdered soda ash with Grade 100 in systems containing SFA.

4. Mixed Actives Systems.

Mixed active systems are desired because the combination of the "oil phase" active nonionic and the "water phase" active LAS makes for the most balanced cleaning systems. For this study, a ratio of two parts nonionic to one part anionic from neutralized SFA was chosen.

Figure 3:
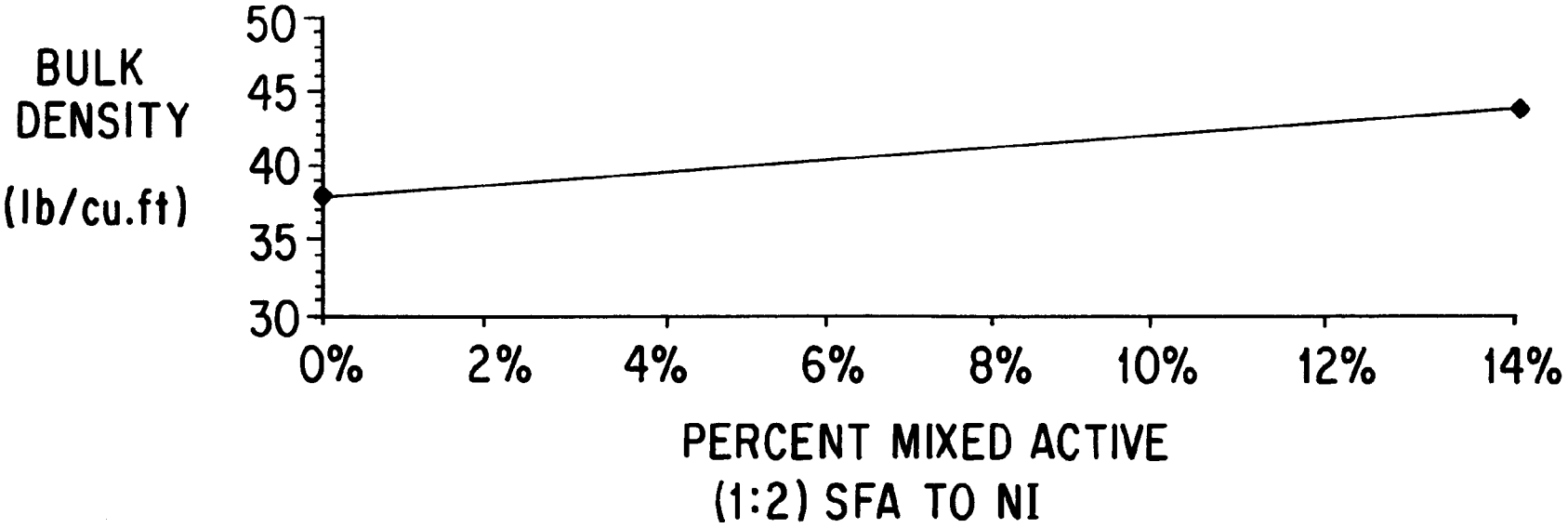
FIG. 3 is a graph depicting the loose bulk density for a detergent vs. mixed actives content for a soda ash having 25 wt % silicate.

These trial runs showed that a maximum total active percent of 15% was processable in the O'Brien. The change in bulk density resulting from this surfactant loading level is given in FIG. 3.

5. Product Caking.

All sample runs were tested in an attempt to predict product caking a processor might experience in mass storage situations such as a silos, flow bins, or even fmal packaging. This caking is due to silicate long-term setting and not angle-of-repose type problems.

These Caking Tests results are given in Table II. These are included as a subjective indication of potential problems, and are not to be used without considerable further testing.

The Caking Test consisted of pulling a small sample of the fresh material in question and leaving it undisturbed on the lab bench in a small container. After at least two hours, an attempt to empty the container was made to subjectively judge how free flowing a freshly made product might act in mass storage. If the material easily discharged without any help, it was judged to have no caking. If the material would not pour out at all, even with "spatula help," caking was severe. These subjective test evaluation between these two extreme conditions were:

Severe Product did not pour out of the container without assistance. The product had to be "hand cleaned" out of the container for any product flow to occur. In mass storage, severe caking would require manual silo cleaning.

Heavy Severe caking, but required much less effort to empty the container. With heavy caking, mass storage silos may be easier to clear, but still a serious problem.

Moderate At least ½ of the product discharged from the container, but the balance of the product sticking to the container had to be scooped out. In mass storage, mechanical flow assist may be sufficient to clear a silo.

Light Light caking only a small amount of the product remained in the container after rotation to empty. Mechanical flow assist will be sufficient to assure product flow.

None No caking, container completely emptied. No flow assist devices would be expected to be needed.

Approximately half of the samples in Table II were rated for the amount of caking that might be expected in mass storage.

It was found that unconditioned samples, containing silicate on soda ash only, always had more caking tendencies than conditioned samples. The soda ash/silicate/surfactant aggregates, however, tended to be caking free. A sample is considered to be caking free if it is in the Light to None category for the caking properties described above.

Cold Water Lumping

The soda ash/silicate/surfactant aggregates of this invention, when placed in ice water for a period of one hour, formed a paste that formed a free flowing slurry, at the end of that time period. This indicates that such aggregates do not exhibit cold water lumping.

O'Brien Agglomerator Study

Table 4, summarizes an O'Brien agglomerator study using an AbsorptaPlus™ soda ash. AbsorptaPlus™ is a trademark of FMC Corporation for a absorptive soda ash of approximately 20.4% absorptivity and a bulk density (B.D.) of approximately 42.7 lbs/ft$^3$.

TABLE I

Batch Weights and Test Formulas

| Agglomeration Data December 1995 one Date | Soda Ash grams | Nonionic grams | SFA grams | Ru Silicate grams | Water grams | Soda Ash % | Nonionic % | SFA % | Ru Silicate % | Water % | Value used in Graphs* | Comments |
|---|---|---|---|---|---|---|---|---|---|---|---|---|
| Run 7/18 #1 | 22,680 | 0 | 0 | 3,110 | 308 | 86.90 | 0.00 | 0.00 | 11.92 | 1.18 | s | |
| Run 7/18 #2 | 22,600 | 0 | 0 | 4,298 | 395 | 82.86 | 0.00 | 0.00 | 15.70 | 1.44 | | Retested |
| Run 7/18 #3 | 11,350 | 2,003 | 0 | 1,123 | 115 | 77.79 | 13.73 | 0.00 | 7.69 | 0.79 | | |
| Run 7/20 #1 | 12,111 | 0 | 0 | 1,837 | 204 | 85.58 | 0.00 | 0.00 | 12.98 | 1.44 | | |
| Run 8/3 #1 | 11,350 | 0 | 0 | 1,571 | 175 | 86.67 | 0.00 | 0.00 | 11.99 | 1.33 | | |
| Run 8/3 #2 | 11,350 | 0 | 0 | 1,575 | 175 | 86.64 | 0.00 | 0.00 | 12.02 | 1.34 | | |
| Run 8/3 #3 | 11,350 | 0 | 0 | 2,250 | 250 | 81.95 | 0.00 | 0.00 | 16.25 | 1.81 | s | |
| Run 8/3 #4 | 11,350 | 0 | 0 | 3,405 | 378 | 75.00 | 0.00 | 0.00 | 22.50 | 2.50 | s | |
| Run 8/3 #5 | 11,350 | 0 | 0 | 2,250 | 250 | 81.95 | 0.00 | 0.00 | 16.25 | 1.81 | | |
| Run 8/17 #1 | 11,350 | 0 | 0 | 4,320 | 480 | 70.28 | 0.00 | 0.00 | 26.75 | 2.97 | s | |
| Run 8/17 #2 | 11,350 | 0 | 0 | 1,497 | 0 | 88.35 | 0.00 | 0.00 | 11.65 | 0.00 | s | |
| Run 8/17 #3 | 11,350 | 0 | 0 | 2,200 | 0 | 83.76 | 0.00 | 0.00 | 16.24 | 0.00 | s | |
| Run 8/17 #4 | 15,209 | 2,700 | 0 | 908 | 101 | 80.39 | 14.27 | 0.00 | 4.80 | 0.53 | | |
| Run 8/17 #4A | 11,350 | 2,003 | 0 | 1,004 | 101 | 78.50 | 13.85 | 0.00 | 6.94 | 0.70 | | |
| Run 8/17 #5 | 11,350 | 0 | 0 | 3,800 | 0 | 74.92 | 0.00 | 0.00 | 25.08 | 0.00 | s | |
| Grade 100 Soda Ash | 100 | 0 | 0 | 0 | 0 | 100.00 | 0.00 | 0.00 | 0.00 | 0.00 | s,n,sfa | |
| Run 8/24 #1 | 11,350 | 2,003 | 0 | 4,692 | 0 | 62.90 | 11.10 | 0.00 | 26.00 | 0.00 | n | |
| Run 8/24 #2 | 13,620 | 2,003 | 0 | 3,766 | 0 | 70.25 | 10.33 | 0.00 | 19.42 | 0.00 | | |
| Run 8/24 #3 | 9,779 | 1,435 | 0 | 3,162 | 0 | 68.02 | 9.98 | 0.00 | 21.99 | 0.00 | n | |
| Run 8/24 #4 | 11,363 | 0 | 712 | 3,813 | 0 | 71.52 | 0.00 | 4.48 | 24.00 | 0.00 | sfa | |
| Run 9/8 #1 | 11,350 | 0 | 1,374 | 4,451 | 0 | 66.08 | 0.00 | 8.00 | 25.92 | 0.00 | sfa | |
| Run 10/16 #1 | 10,800 | 1,800 | 900 | 2,140 | 0 | 69.05 | 11.51 | 5.75 | 13.68 | 0.00 | | |
| Run 9/28 #1 | 11,350 | 0 | 2,004 | 4,451 | 0 | 63.75 | 0.00 | 11.26 | 25.00 | 0.00 | sfa | |
| Run 9/28 #2 | 11,350 | 0 | 1,374 | 4,451 | 0 | 66.08 | 0.00 | 8.00 | 25.92 | 0.00 | sfa | |
| Run 9/28 #3 | 11,350 | 0 | 1,374 | 4,451 | 135 | 65.57 | 0.00 | 7.94 | 25.71 | 0.78 | sfa | |
| Run 10/3 #1 | 10,800 | 2,700 | 0 | 4,500 | 0 | 60.00 | 15.00 | 0.00 | 25.00 | 0.00 | n | |
| Run 10/3 #2 | 10,800 | 3,166 | 0 | 4,655 | 0 | 58.00 | 17.00 | 0.00 | 25.00 | 0.00 | n | |
| Run 10/3 #3 | 10,800 | 0 | 1,662 | 4,154 | 0 | 65.00 | 0.00 | 10.00 | 25.00 | 0.00 | sfa | |
| Run 10/4 #1 | 10,800 | 1,800 | 900 | 2,140 | 0 | 69.05 | 11.51 | 5.57 | 13.68 | 0.00 | | |
| Run 10/4 2A | 10,800 | 2,592 | 0 | 3,888 | 0 | 62.50 | 15.00 | 0.00 | 22.50 | 0.00 | n | |
| Run 10/4 2B | 10,800 | 3,456 | 0 | 3,888 | 0 | 59.52 | 19.05 | 0.00 | 21.43 | 0.00 | | |
| Run 10/4 2C | 10,800 | 3,888 | 0 | 3,888 | 0 | 58.14 | 20.93 | 0.00 | 20.93 | 0.00 | | |
| Run 11/21 #2 | 10,800 | 2,200 | 0 | 4,500 | 0 | 60.00 | 15.00 | 0.00 | 25.00 | 0.00 | Gen Chem Lite | |
| Run 11/21 #3 | 10,440 | 3,060 | 0 | 4,500 | 0 | 58.00 | 17.00 | 0.00 | 25.00 | 0.00 | Gen Chem Lite | |
| Run 12/5 #1 | 10,030 | 3,420 | 0 | 4,500 | 0 | 56.00 | 19.00 | 0.00 | 25.00 | 0.00 | Gen Chem Lite | |
| Run 12/5 #2 | 9,270 | 3,780 | 0 | 4,500 | 0 | 54.00 | 24.00 | 0.00 | 25.00 | 0.00 | Gen Chem Lite | |
| Run 12/8 #1 | 9,360 | 4,140 | 0 | 4,500 | 0 | 52.00 | 23.00 | 0.00 | 25.00 | 0.00 | Gen Chem Lite | |
| Run 12/13 #1 | 6,400 | 0 | 2,340 | 4,500 | 0 | 62.00 | 0.00 | 14.00 | 25.00 | 0.00 | Gen Chem Lite | |

TABLE II

Material Properties

| Agglomeration Data December 1995 two Date | Bulk Density lb/cu ft. thru 10 mesh (fresh) | Flowability (angle of repose) all in degrees | Screen Analysis % −60 mesh | Caking | Comments |
|---|---|---|---|---|---|
| Run 7/18 #1 | 42 | N/A | 6.5 | N/A | |
| Run 7/18 #2 | 32 | N/A | 0.5 | N/A | not used |
| Run 7/18 #3 | 47 | N/A | 13.7 | N/A | |
| Run 7/20 #1 | N/A | N/A | N/A | Slight | Used flat spray nozzle |
| Run 8/3 #1 | N/A | N/A | N/A | | First use of atomizing nozzle |
| Run 8/3 #2 | 48 | 42 | 23.9 | Light | Repeat of Run 8/3 #1 at different RPM |
| Run 8/3 #3 | 46 | 42 | 18 | slight | |
| Run 8/3 #4 | 38 | 42 | 1.9 | heavy | 25% dilute silicate on soda ash |
| Run 8/3 #5 | 43 | 42 | 6.1 | heavy | 18% dilute silicate on soda ash |
| Run 8/17 #1 | 43 | 42 | 0.3 | moderate | 30% dilute silicate on soda ash |
| Run 8/17 #2 | 55 | 43 | 28 | none | "13%" Ru silicate as is on soda ash |
| Run 8/17 #3 | 48 | 46 | 17.5 | none | 18% Ru silicate as is on soda ash |
| Run 8/17 #4 | 60 | 72 | 23.7 | N/A | Premix separate step |
| Run 8/17 #4A | 55 | 64 | 23.7 | slight | |
| Run 8/17 #5 | 38 | 47 | 0.6 | heavy | 2.5% Ru silicate as is on soda ash |
| Grade 100 Soda Ash | 51 | N/A | N/A | none | Grade 100 ash |
| Run 8/24 #1 | 39 | 48 | 1.8 | heavy | |
| Run 8/24 #2 | 41 | 48 | 0.6 | moderate | |
| Run 8/24 #3 | 38 | 46 | 1 | moderate | |
| Run 8/24 #4 | 39 | 47 | 2.3 | N/A | |
| Run 9/8 #1 | 40 | 68 | 4.8 | heavy | |
| Run 10/16 #1 | 45 | 66 | 1.4 | N/A | |
| Run 9/28 #1 | 44 | 68 | 0.8 | N/A | |
| Run 9/28 #2 | 42 | 60 | 2 | N/A | |
| Run 9/28 #3 | 42 | 59 | 1.2 | N/A | |
| Run 10/3 #1 | 38 | 48 | 0.6 | N/A | |
| Run 10/3 #2 | 46 | 66 | 2.8 | N/A | |
| Run 10/3 #3 | 45 | 58 | 0.9 | N/A | |
| Run 10/4 #1 | 43 | 70 | 0.8 | N/A | |
| Run 10/4 2A | 42 | 56 | 0.3 | N/A | Base for past acid test |
| Run 10/4 2B | 44 | 70 | 0.8 | N/A | Post add 5% nonionic - wet |
| Run 10/4 2C | 44 | 66 | 0 | N/A | Post add another 2.5% (total 7.5%) - wet |
| Run 11/21 #2 | 45 | 57 | 12.8 | N/A | General Chem Lt soda ash |
| Run 11/21 #3 | 42 | N/A | 2.4 | N/A | General Chem Lt soda ash |
| Run 12/5 #1 | 40 | 70 | 0.1 | N/A | General Chem Lt soda ash |
| Run 12/5 #2 | 40 | 72 | 0.9 | N/A | General Chem Lt soda ash |
| Run 12/8 #1 | 36 | 74 | 0 | N/A | General Chem Lt soda ash |
| Run 12/13 #1 | 35 | 70 | 1.1 | N/A | General Chem Lt soda ash |

TABLE III A

Screen Analysis and Operation Data

| Agglomeration Data December 1995 three | on 20 mesh percent | −20/+40 mesh percent | −40/+60 mesh percent | −60/+80 mesh percent | minus 80 mesh percent | Agglomerator rpm | Silicate Temp. (deg C.) | Silicate Pressure (psi) | Silicate Rate (minutes) |
|---|---|---|---|---|---|---|---|---|---|
| Run 7/18 #1 | | | | | | | | | |
| Run 7/18 #2 | | | | | | | | | |
| Run 7/18 #3 | | | | | | | | | |
| Run 7/20 #1 | — | — | — | — | — | 4.50 | 65 | 70 | 3.00 |
| Run 8/3 #1 | — | — | — | — | — | | 75 | 80 | |
| Run 8/3 #2 | 12.2 | 35 | 28.9 | 14 | 9.9 | 8.00 | 75 | 80 | 2.17 |
| Run 8/3 #3 | 18.1 | 40 | 23.9 | 11.6 | 6.4 | 8.00 | 75 | 80 | 2.17 |
| Run 8/3 #4 | 35.6 | 53.4 | 9.1 | 1.4 | 0.5 | 8.00 | 75 | 80 | 3.00 |
| Run 8/3 #5 | 23.4 | 48.4 | 21.3 | 5 | 1.9 | 8.00 | 75 | 80 | 3.00 |
| Run 8/17 #1 | 70.6 | 28.3 | 0.8 | 0.3 | 0 | 8.00 | 70 | 30 | |
| Run 8/17 #2 | 24.6 | 19.5 | 27.6 | 16.5 | 11.8 | 8.00 | 70 | 40 | 2.00 |
| Run 8/17 #3 | 29.8 | 28.7 | 30 | 6.3 | 5.2 | 8.00 | 70 | 40 | |
| Run 8/17 #4 | | | | | | | | | |
| Run 8/17 #4A | | | | | | 8.00 | 70 | 40 | |
| Run 8/17 #5 | 15.6 | 29 | 33 | 14.4 | 8 | | | | |
| Grade 100 Soda Ash | 81.5 | 16 | 1.9 | 0.2 | 0.4 | 8.00 | 45 | 50 | |
| Run 8/24 #1 | 79.1 | 14.8 | 4.3 | 1 | 0.8 | 8.00 | 45 | 50 | |
| Run 8/24 #2 | 74.6 | 22.4 | 2.4 | 0.2 | 0.4 | 8.00 | 45 | 50 | |

TABLE III A-continued

| Agglomeration Data December 1995 three | on 20 mesh percent | −20/+40 mesh percent | −40/+60 mesh percent | −60/+80 mesh percent | minus 80 mesh percent | Agglomerator rpm | Silicate Temp. (deg C.) | Silicate Pressure (psi) | Silicate Rate (minutes) |
|---|---|---|---|---|---|---|---|---|---|
| Run 8/24 #3 | 82.3 | 14.6 | 2.1 | 0.5 | 0.5 | 8.00 | 45 | 50 | |
| Run 8/24 #4 | 54.6 | 34.3 | 8.8 | 1.5 | 0.8 | 8.00 | 45 | 50 | |
| Run 9/8 #1 | 51.4 | 31.9 | 11.9 | 3.2 | 1.6 | 8.00 | | | |
| Run 10/16 #1 | 39.6 | 42 | 17 | 0.7 | 0.7 | | | | |
| Run 9/28 #1 | 79.8 | 18.3 | 1.1 | 0.1 | 0.7 | | | | |
| Run 9/28 #2 | 65.4 | 23.6 | 5 | 1 | 1 | | | | |
| Run 9/28 #3 | 80 | 16.7 | 2.1 | 0.5 | 0.7 | | | | |
| Run 10/3 #1 | 83.2 | 8.6 | 7.5 | 0.7 | 0 | | | | |
| Run 10/3 #2 | 55.3 | 22.9 | 19 | 2.4 | 0.4 | | | | |
| Run 10/3 #3 | 60.9 | 27.3 | 10.9 | 0.9 | 0 | | | | |
| Run 10/4 #1 | 32.7 | 52.8 | 13.7 | 0.8 | 0 | | | | |
| Run 10/4 2A | 78.8 | 20 | 0.9 | 0.3 | 0 | | | | |
| Run 10/4 2B | 81.3 | 17.7 | 1 | 0 | 0 | | | | |
| Run 10/4 2C | 86.1 | 13.8 | 0.1 | 0 | 0 | | | | |
| Run 11/21 #2 | 36.8 | 30.4 | 20 | 9.8 | 3 | | | | |
| Run 11/21 #3 | 36 | 35.6 | 25 | 2.4 | 0 | | | | |
| Run 12/5 #1 | 29.3 | 38.3 | 23.3 | 8.6 | 0.1 | | | | |
| Run 12/5 #2 | 36.5 | 47 | 15.6 | 0.9 | 0 | | | | |
| Run 12/8 #1 | 85 | 15 | 0 | 0 | 0 | | | | |
| Run 12/13 #1 | 25.8 | 42 | 30.2 | 1.1 | 0 | | | | |

TABLE IIIB

| EXAMPLE RUN NUMBER | SODA ASH % | NONIONIC % | SFA % | Ru SILICATE % | WATER % | VALUE USED IN GRAPHS | B.D. lb/ft3 | gms/cc | Angle |
|---|---|---|---|---|---|---|---|---|---|
| #1 Run 10/3 | 58 | 17 | 0 | 12.5 | 12.5 | n | 46 | | 66 |
| #2 Run 10/4 | 62.5 | 15 | 0 | 11 | 11 | n | 42 | | 56 |
| #3 Run 10/4 | 59.52 | 19.05 | 0 | 10.5 | 10.5 | | 44 | 70 | |
| #4 Run 6/24 | 69.2 | 20.8 | | 10 | | | 40.1 | 0.643 | 72 |
| #5 Run 6/24 | 62.3 | 22.7 | | 15 | | | 46.2 | 0.74 | 70 |

TABLE 4

O,Brien Agglomeration Study, With AbsorptaPlus

| | B.D. lb/ft3 | B.D. gms/cc | Angle | Particle Size Distribution % Cumm 20 mesh | 40 mesh | 60 mesh | 80 mesh | 100 mesh | 200 mesh | Pan |
|---|---|---|---|---|---|---|---|---|---|---|
| Run 6/24-1 absorptaPlus & Triton × 100<br>Soda Ash = 12000 g (80%)<br>Triton × 100 = 3000 g (20%) | 49.2 | 0.788 | 65 | 1.9 | 19.1 | 58.6 | 87.8 | 96 | 100 | 100 |
| Run 6/24-1A absorptaPlus & Triton × 100, and RU Silicate<br>Soda Ash = 1200 g (72%)<br>Triton × 100 = 3000 g (18%)<br>RU Silicate = 1667 g (10%) | 40.6 | 0.65 | 67 | 26.8 | 66.2 | 97.6 | 100 | 100 | 100 | 100 |
| Run 6/24-2 absorptaPlus & Triton × 100<br>Soda Ash = 11540 g (76.9%)<br>Triton × 100 = 3460 g (23.1%) | 51.5 | 0.825 | 68 | 7.5 | 25.2 | 63.6 | 88.6 | 97.3 | 100 | 100 |
| Run 6/24-2A absorptaPlus & Triton × 100, and RU Silicate<br>Soda Ash = 11540 g (69.2%)<br>Triton × 100 = 3460 g (20.8%)<br>RU Silicate = 1667 g (10%) | 40.1 | 0.643 | 72 | 34.3 | 87 | 99.5 | 100 | 100 | 100 | 100 |
| Run 6/24-3 absorptaPlus & Triton × 100<br>Soda Ash = 10383 g (73.3%)<br>Triton × 100 = 3783 g (26.7%) | 46.2 | 0.74 | 70 | 6.9 | 89.4 | 97.6 | 99.3 | 100 | 100 | 100 |

TABLE 4-continued

| O,Brien Agglomeration Study, With AbsorptaPlus | | | | | | | | | | |
|---|---|---|---|---|---|---|---|---|---|---|
| | B.D. | | | Particle Size Distribution % Cumm | | | | | | |
| | lb/ft3 | gms/cc | Angle | 20 mesh | 40 mesh | 60 mesh | 80 mesh | 100 mesh | 200 mesh | Pan |
| Run 6/24-3A absorptaPlus & Triton × 100, and RU Silicate<br>Soda Ash = 10383 g (62.3%)<br>Triton × 100 = 3783 g (22.7%)<br>RU Silicate = 2500 g (15.0%) | 41.3 | 0.662 | 69 | 59.7 | 96.7 | 100 | 100 | 100 | 100 | 100 |
| Run 6/12-1 absorptaPlus & Triton × 100<br>Soda Ash = 9900 g (73.3%)<br>Triton × 100 = 3600 g (26.7%) | 39.6 | 0.635 | 72 | 5.4 | 70.6 | 98.2 | 99 | 100 | 100 | 100 |
| Run 6/12-1A absorptaPlus & Triton × 100, and RU Silicate<br>Soda Ash = 9900 g (57.1%)<br>Triton × 100 = 3600 g (20.8%)<br>RU Silicate = 3500 g (22.1%) | 39.6 | 0.634 | 50 | 85.4 | 99.5 | 99.6 | 99.7 | 99.8 | 99.9 | 100 |
| Raw AbsorptaPlus Soda Ash | 41.4 | 0.663 | 48 | 1.2 | 14.1 | 54.3 | 83.1 | 92.2 | 99.7 | 100 |

We claim:

1. A method for producing a powdered detergent aggregate comprising in an agglomerator which cascades powder to form a curtain a single pass process having the steps of first introducing an absorptive soda ash to the agglomerator, forming a soda ash curtain therefrom within the agglomerator, spraying a surfactant onto the soda ash curtain to form a curtain of the resultant soda ash/surfactant product, spraying a silicate thereon to produce soda ash, silicate and surfactant agglomerate having more than 15 wt % surfactant, and adding additional surfacant to the agglomerate to further increase the amount of surfacant on the agglomerate to obtain a powdered detergent aggregate having a loose bulk density in the range of 600–1000 g/L.

2. The method of claim 1 wherein the surfactant is a nonionic surfactant, and the agglomerate is free of caking.

3. The method of claim 1 wherein the surfactant is a mixture of nonionic and anionic surfactant.

4. The method of claim 1 further including the step of conditioning the powdered detergent aggregate by continuing the formation of a curtain of the powdered detergent aggregate in the agglomerator for a period of from 2 to 60 minutes.

5. The method of claim 3 wherein the step of adding additional surfactant to the agglomerate provides a powdered detergent aggregate having from 19–26 weight percent surfactant based on the weight of the soda ash, silicate, surfactant in the powdered detergent aggregate.

6. The method of claim 5 further including the step of conditioning the powdered detergent aggregate by continuing the formation of a curtain of the powdered detergent aggregate in the agglomerator for a period of from 2–60 minutes.

7. A method for producing a powdered detergent aggregate having a loose bulk density within the range of from 600–1000 g/L comprising in a single pass process, without adding heat other than the heat contained in the ingredients used therein, introducing a soda ash to an agglomerator, forming a soda ash curtain within the agglomerator, spraying a surfactant onto the soda ash curtain to form a curtain of the resultant soda ash/surfactant product, and spraying a silicate thereon to produce soda ash, silicate and surfacant agglomerate, wherein the soda ash, silicate and surfactant are used on a percentage basis 40–69, 7–14, 15–22, respectively based on the total weight of the soda ash, silicate, surfactant, and water of hydration in the detergent and subsequently in the same single pass process spraying the agglomerate with from 4 to 9 weight percent additional surfactant to provide a powdered detergent aggregate having from 19–26 weight percent surfactant.

8. The method of claim 7 wherein the soda ash used as a starting material has a length to width ratio of from 5:1 to 2.5:1.

9. The method of claim 8 wherein the surfactant is selected from the group consisting of nonionic and anionic surfactant.

10. A method for producing a powdered detergent aggregate having a loose bulk density within the range of from 600–800 g/L comprising in a single pass process, without adding heat other than the heat contained in the ingredients used therein, introducing a soda ash to an agglomerator, forming a soda ash curtain within the agglomerator, to form a curtain of the resultant soda ash/surfactant product, and spraying a silicate thereon to produce soda ash, silicate and surfactant agglomerate, wherein the soda ash, silicate and surfactant are used on a percentage basis 40–69, 7–14, 15–22, respectively based on the total weight of the soda ash, silicate, surfactant, and water of hydration in the detergent and subsequently in the same single pass process spraying the agglomerate with from 4 to 9 weight percent additional surfactant to provide a powdered detergent aggregate having from 19–26 weight percent surfactant.

11. The method of claim 10, wherein the soda ash used as a starting material has a length to width ratio of from 5:1 to 2.5:1.

12. The method of claim 11 wherein the surfactant is selected from the group consisting of nonionic and anionic surfactant.

13. The method of claim 12 wherein the powered detergent aggregate is phosphate free.

* * * * *